United States Patent [19]

Pampuch et al.

[11] 3,952,873

[45] Apr. 27, 1976

[54] CONTAINER FOR TUBULAR GLASS EQUIPMENT

[76] Inventors: Klaus Pampuch, Neubrucker Str. 40, 1 Berlin 28; Gunter Wanke, Suderoder Str. 30, 1 Berlin 47, both of Germany

[22] Filed: Oct. 31, 1974

[21] Appl. No.: 519,397

[30] Foreign Application Priority Data

Nov. 23, 1973 Germany ..... 2359041

[52] U.S. Cl. ..... 206/528; 206/419; 220/339

[51] Int. Cl.[2] ..... B65D 83/02; B65D 85/20; B65D 85/42

[58] Field of Search ..... 206/379, 418–420, 206/521, 528, 530; 220/337, 339

[56] References Cited

UNITED STATES PATENTS

| | | | |
|---|---|---|---|
| 1,826,809 | 10/1931 | Metz | 206/530 |
| 2,598,492 | 5/1952 | Boës | 206/528 |
| 2,844,244 | 7/1958 | Hanson | 206/379 |
| 3,154,192 | 10/1964 | Cowley | 206/379 |
| 3,499,525 | 3/1970 | Kanter | 206/379 |

FOREIGN PATENTS OR APPLICATIONS

| | | | |
|---|---|---|---|
| 1,472,395 | 3/1967 | France | 206/528 |
| 1,118,144 | 5/1956 | France | 206/521 |

*Primary Examiner*—William Price
*Assistant Examiner*—Steven E. Lipman
*Attorney, Agent, or Firm*—Smythe & Moore

[57] ABSTRACT

A container for holding tubular glass equipment, such as glass tubes having breakable closed ends or ampoules.

7 Claims, 3 Drawing Figures

CONTAINER FOR TUBULAR GLASS EQUIPMENT

The invention relates to a container of thermoplastic plastic for receiving easily breakable, tubular glass equipment, particularly test tubes, consisting of two housing parts, an upper and a lower part, connected on one side by a film or thin hinge strip, closable on the other side with a snap closure, and with holding means and securing safety means located on the insides of the housing parts.

In the case of containers of the type involved herein, which the user generally carries with him, it is necessary that they be made in a sturdy and also compact manner so that the glass equipment and glass objects are easily accessible and can be removed without danger of breakage. The tips of the sealed parts of these objects are particularly likely to be broken. The glass tubes may have sealed parts on both sides or ends, at least one of which may be broken off before the tubes or contents can be used. The ends are therefore sensitive and subject to premature breakage. However, the container is not only intended to protect the tubes but also serves as a packing for a certain number of tubes and constitutes a disposable part. Known packings or containers for tubes of the type concerned previously used loosely inserted foam parts to protect the sealed parts. The tube also can have only one end breakable.

The invention is based on the aspect of providing a container which is simple to produce and in which the glass equipment or articles can be packed and again removed in a simple manner, and where the articles are secured in their position and the particularly sensitive end parts are protected.

In accordance with the invention, this desired result is obtained by providing a housing part wherein the holding means and securing safety means form a unit made of thermoplastic or synthetic plastic. Holding tongues or clips are provided as holding means and pins are arranged in a brushwise manner at those points where the particularly sensitive or breakable end points of the tubes are located.

A further advantageous refinement of the invention is that the holding tongues have a thickness which is dimensioned such that, although they produce an elastic effect, they will, as far as possible, be subject to only slight permanent changes of shape. The tongues or clips are equipped with cam-like reinforcements at their free ends. In this way, the tube is embraced by the holding tongues or clips and a firm hold for a tube is achieved.

The pins are arranged in a brushwise manner which secure the position of the tubes in their longitudinal direction and protect the sealed parts or ends and are tapered conically in the direction of their free ends. In this way they also exert a certain upward force on the inserted tube, which makes possible an easier removal of the tube.

Advantageously, a bushing or apertured means is provided in each of the long sides of the housing parts which permits the tip of a tube to be inserted therein so as to break off the tips of the tubes before use.

An embodiment of the invention is shown in the drawing.

Figure 1:
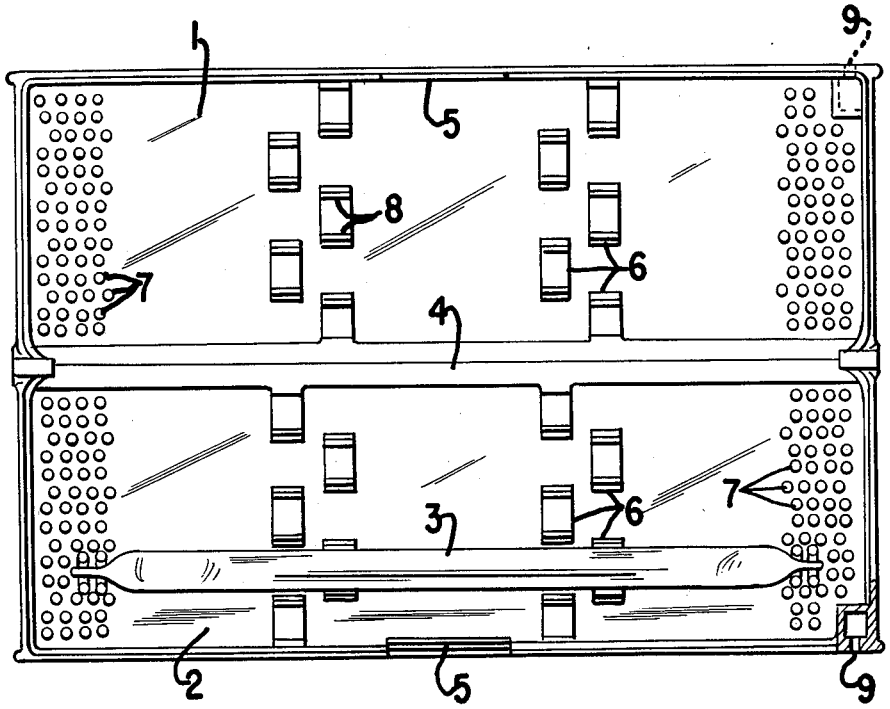
FIG. 1 shows a container opened on its hinge.
Figure 2:
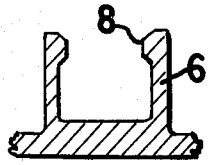
FIG. 2 shows the design of a holding tongue.
Figure 3:
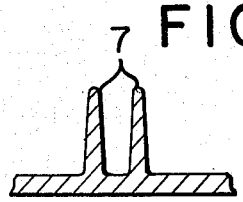
FIG. 3 shows the tapered conical shape of the holding pins.

The container consists of two housing parts 1 and 2, in which the tubes 3 are packed, only a single tube being shown.

The housing parts 1, 2 are connected to each other by a film or thin hinge strip 4. The container can be held closed by means of a snap closure 5.

The holding tongues or clips 6 with the cams 8 embrace tubes 3. In the form illustrated, five tubes can be placed in each housing part 1, 2 of the container. The sealed parts of the tubes are located between the rods or pins 7 which are arranged in a brushwise manner and which will secure or hold the tube in its longitudinal direction by their elasticity and will protect the sealed parts.

Bushings or apertured means 9 will permit the tip of a tube to be inserted therein so that the tube tips can be broken off. The apertured means are located on the long sides of the housing parts 1 and 2.

It should be apparent that details of construction can be varied without departing from the spirit of the invention except as defined in the appended claims.

What is claimed is:

1. A synthetic plastic container for receiving easily breakable tubular glass articles having sealed ends therein comprising a housing having an upper and lower part connected by hinge strip means along one side, a snap closure means along the other side of said upper and lower parts, holding clips extending from at least one of said upper and lower parts for holding said tubular glass articles therein and having groups of spaced pins arranged in a brushwise manner extending inwardly from said housing at opposing ends of at least one of said parts and located at zones where the sealed ends of said glass articles are reduced and sensitive.

2. A synthetic plastic container as claimed in claim 1 wherein the holding clips extend from both the upper and lower parts.

3. A synthetic plastic container as claimed in claim 2 wherein there are cam-like reinforcements adjacent the free ends of said clips.

4. A synthetic plastic container as claimed in claim 3 wherein said pins are conically tapered in the direction of the free ends thereof.

5. A synthetic plastic container as claimed in claim 4 wherein the tubular glass articles have sealed ends and the housing has break-off means therein for receiving a sealed end to assist in breaking the same.

6. A synthetic plastic container as claimed in claim 1 wherein said pins are conically tapered in the direction of the free ends thereof.

7. A synthetic plastic container as claimed in claim 1 wherein the tubular glass articles have sealed ends and the housing has break-off means therein for receiving a sealed end to assist in breaking the same.

* * * * *